US010941463B2

(12) United States Patent
Park et al.

(10) Patent No.: US 10,941,463 B2
(45) Date of Patent: Mar. 9, 2021

(54) HIGH-ENTROPY ALLOY FOAM AND MANUFACTURING METHOD FOR THE FOAM

(71) Applicant: Seoul National University R&DB Foundation, Seoul (KR)

(72) Inventors: Eun Soo Park, Suwon (KR); Kooknoh Yoon, Seoul (KR); Khurram Yaqoob, Islamabad (PK); Je In Lee, Seoul (KR); Jin Yeon Kim, Seoul (KR)

(73) Assignee: SEOUL NATIONAL UNIVERSITY R & DB FOUNDATION, Seoul (KR)

( * ) Notice: Subject to any disclaimer, the term of this patent is extended or adjusted under 35 U.S.C. 154(b) by 0 days.

(21) Appl. No.: 16/743,031

(22) Filed: Jan. 15, 2020

(65) Prior Publication Data

US 2020/0165705 A1 May 28, 2020

Related U.S. Application Data

(62) Division of application No. 15/414,778, filed on Jan. 25, 2017, now abandoned.

(30) Foreign Application Priority Data

Jan. 29, 2016 (KR) ..... 10-2016-0011313
May 30, 2016 (KR) ..... 10-2016-0066416

(51) Int. Cl.
*C22C 1/08* (2006.01)
*B22D 25/00* (2006.01)
(Continued)

(52) U.S. Cl.
CPC ..... *C22C 1/08* (2013.01); *B22D 25/005* (2013.01); *C22C 3/005* (2013.01); *C22C 30/02* (2013.01);
(Continued)

(58) Field of Classification Search
CPC ..... C22C 1/08; C22C 30/02; C22C 3/005; C22C 1/0433; C22C 1/0425; C23F 1/28;
(Continued)

(56) References Cited

U.S. PATENT DOCUMENTS 4,977,038 A * 12/1990 Sieradzki ..... B01D 67/0044 428/610
2013/0108502 A1* 5/2013 Bei ..... C22C 30/00 420/591
(Continued)

FOREIGN PATENT DOCUMENTS

JP 2002173732 A * 6/2002

OTHER PUBLICATIONS

Hsu, et al "Wear Resistance and High-Temperature Compression Strength of Fcc CuCoNiCrAl0.5Fe Alloy with Boron Addition" Metallurgical and Materials Transactions A, 35A, 1465-69, May 2004. (Year: 2004).*
(Continued)

*Primary Examiner* — Anita K Alanko
(74) *Attorney, Agent, or Firm* — Lex IP Meister, PLLC

(57) ABSTRACT

The present invention relates to a HEA foam prepared by selective dissolution of a second phase within a two-phase separating alloy comprising the HEA and a manufacturing method thereof. The manufacturing method of the HEA foam of the present invention has the effect of preparing a novel HEA foam, which was not available in the past, by leaving only a first phase after manufacturing a two-phase separating alloy comprising a first phase by HEA, wherein at least 3 metal elements act as a common solvent. Furthermore, the HEA foam of the present invention has a structure, wherein pores are distributed inside the HEA, in which at least 3 metal elements act as a common solvent. By adding a functional characteristic of low heat conductivity, etc., to
(Continued)

the existing high strength characteristic of HEA, the HEA foam of the present invention can exhibit a complex effect by the combination of the two particular effects, thereby being capable of exhibiting excellent physical characteristics.

13 Claims, 13 Drawing Sheets

(51) Int. Cl.

| | |
|---|---|
| ***C22C 30/02*** | (2006.01) |
| ***C22C 3/00*** | (2006.01) |
| ***C23F 1/28*** | (2006.01) |
| ***C23F 1/30*** | (2006.01) |
| ***C23F 1/00*** | (2006.01) |
| ***C23F 1/26*** | (2006.01) |
| *B22F 3/10* | (2006.01) |
| *C22C 1/04* | (2006.01) |

(52) U.S. Cl.
CPC ..... *C23F 1/00* (2013.01); *C23F 1/26* (2013.01); *C23F 1/28* (2013.01); *C23F 1/30* (2013.01); *B22F 3/10* (2013.01); *C22C 1/0425* (2013.01); *C22C 1/0433* (2013.01); *Y10T 428/12* (2015.01); *Y10T 428/12479* (2015.01)

(58) Field of Classification Search
CPC ..... C23F 1/30; C23F 1/00; C23F 1/26; B22D 25/005; B22F 3/10; Y10T 428/12; Y10T 428/12479
See application file for complete search history.

(56) References Cited

U.S. PATENT DOCUMENTS

2015/0057144 A1* 2/2015 Erlebacher ..... C22C 14/00 501/96.1
2018/0057912 A1* 3/2018 Park ..... C22B 9/22

OTHER PUBLICATIONS

Wada et al "Nano- to submicro-porous B—Ti alloy prepared from dealloying in a metallic melt" Scripta Materialia 65, 532-35 (2011). (Year: 2011).*
Senkov, O.N. et al "Microstructure and Properties of Aluminum-Containing Refractory High-Entropy Alloys" 66(10) 2030-42, published online Jul. 31, 2014. (Year: 2014).*

* cited by examiner

FIG. 2

| | Element Group I | | | Element Group II | | | | |
|---|---|---|---|---|---|---|---|---|
| | Cu | Ag | Au | Cr | Mn | Fe | Co | Ni |
| Cu | 0 | +2 | -9 | +12 | +4 | +14 | +6 | +4 |
| Ag | Sym. | 0 | -6 | +27 | +13 | +28 | +19 | +15 |
| Au | Sym. | Sym. | 0 | 0 | -11 | +8 | +7 | +7 |
| Cr | Sym. | Sym. | Sym. | 0 | +2 | -1 | -4 | -7 |
| Mn | Sym. | Sym. | Sym. | Sym. | 0 | 0 | -5 | -8 |
| Fe | Sym. | Sym. | Sym. | Sym. | Sym. | 0 | -1 | -2 |
| Co | Sym. | Sym. | Sym. | Sym. | Sym. | Sym. | 0 | 0 |
| Ni | Sym. | Sym. | Sym. | Sym. | Sym. | Sym. | Sym. | 0 |

| EDS data | Point 1 (at.%) | Point 2 (at.%) |
|---|---|---|
| Cu | 4.74 | 92.34 |
| Fe | 24.59 | 0.45 |
| Ni | 19.59 | 5.75 |
| Co | 26.19 | 0.68 |
| Cr | 24.15 | 0.28 |
| Sum. | 100 | 100 |

FIG. 5

| | | Y | La | ··· | Er | Ti | V | Cr | Zr | Nb | Mo | Hf | Ta | W |
|---|---|---|---|---|---|---|---|---|---|---|---|---|---|---|
| Element Group III | Y | - | 0 | ··· | 0 | +15 | +17 | +11 | +10 | +30 | +24 | +13 | +27 | +24 |
| | La | Sym. | - | ··· | 0 | +20 | +22 | +17 | +13 | +36 | +31 | +15 | +30 | +29 |
| | ⋮ | Sym. | Sym. | - | ⋮ | ⋮ | ⋮ | ⋮ | ⋮ | ⋮ | ⋮ | ⋮ | ⋮ | ⋮ |
| | Er | Sym. | Sym. | Sym. | - | +13 | +14 | +10 | +7 | +26 | +20 | +10 | +23 | +19 |
| Element Group IV | Ti | Sym. | Sym. | Sym. | Sym. | | -2 | -7 | 0 | -4 | -4 | 0 | -1 | -6 |
| | V | Sym. | Sym. | Sym. | Sym. | Sym. | - | -2 | -3 | -1 | 0 | -2 | 1 | 1 |
| | Cr | Sym. | Sym. | Sym. | Sym. | Sym. | Sym. | - | -2 | -7 | 0 | -7 | -7 | -4 |
| Element Group V | Zr | Sym. | Sym. | Sym. | Sym. | Sym. | Sym. | Sym. | | -14 | -6 | 0 | -13 | -9 |
| | Nb | Sym. | Sym. | Sym. | Sym. | Sym. | Sym. | Sym. | Sym. | | -4 | -2 | 0 | -9 |
| | Mo | Sym. | Sym. | Sym. | Sym. | Sym. | Sym. | Sym. | Sym. | Sym. | | -2 | -3 | 0 |
| | Hf | Sym. | Sym. | Sym. | Sym. | Sym. | Sym. | Sym. | Sym. | Sym. | Sym. | | -13 | -4 |
| | Ta | Sym. | Sym. | Sym. | Sym. | Sym. | Sym. | Sym. | Sym. | Sym. | Sym. | Sym. | | -7 |
| | W | Sym. | Sym. | Sym. | Sym. | Sym. | Sym. | Sym. | Sym. | Sym. | Sym. | Sym. | Sym. | |

* Element group I includes lanthanide elements such La, Ce, Nd, Gd, Tb, Dy, Ho, and Er, in addition to Y

*As shown above, Element Group I includes lanthanide elements such La, Ce, Nd, Gd, Tb, Dy, Ho, and Er, in addition to Y FIG. 7
a) Concept diagram for preparing a high-entropy alloy with phase separation
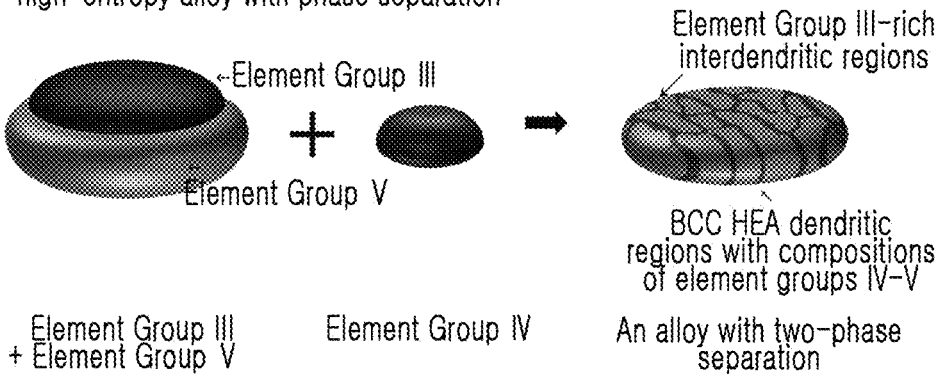
b) Actual process of forming a complex structure of BCC HEA
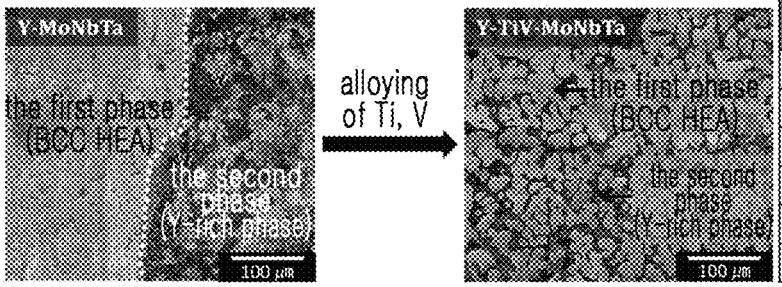
| | the first phase | the second phase |
|---|---|---|
| Y | 0.45 | 90.62 |
| Ti | 23.75 | 5.22 |
| V | 23.95 | 2.41 |
| Mo | 17.92 | 0.44 |
| Nb | 17.08 | 0.00 |
| Ta | 16.85 | 1.31 |

HIGH-ENTROPY ALLOY FOAM AND MANUFACTURING METHOD FOR THE FOAM

CROSS-REFERENCE TO RELATED APPLICATION

This application is a Divisional Application of U.S. patent application Ser. No. 15/414,778 filed on Jan. 25, 2017, which claims priority to and the benefit of Korean Patent Application Nos. 10-2016-0011313 and 10-2016-0066416, filed in the Korean Intellectual Property Office on Jan. 29, 2016, and May 30, 2016, respectively, the entire contents of which are incorporated herein by reference.

BACKGROUND OF THE INVENTION

(a) Field of the Invention

The present invention relates to high-entropy alloy (HEA) foam and, more specifically, to HEA foam prepared by selective dissolution of an immiscible metal (alloy) in a two-phase separating alloy, which includes a first phase including HEA prepared by the principle of forming a miscibility gap and morphology control, and a second phase including an immiscible metal (or alloy), and a manufacturing method for the foam.

(b) Description of the Related Art

High-entropy alloy (HEA) is an alloy system, in which several metal elements are comprised in similar ratios and thus multiple kinds of elements act as a major element, and high mixed entropy is induced due to similar atomic ratios within an alloy, and accordingly, a solid solution with a stable and simple structure is formed at high temperature instead of an intermetallic compound or intermediate phase.

Since the solid solution has a main element of multi-components, a complex internal stress appears by configuration entropy and correlation induced by the constituting elements, and thus a significant lattice deformation is induced. Additionally, all of the plurality of alloy elements act as solvent atoms and they thus have a very slow speed, and accordingly, the precipitation on the second phase at high temperature is delayed and mechanical characteristics are maintained. The HEA is characterized in that it is an alloy system having 1) at least 3 alloying elements, 2) a similar difference in the size between similar atoms, which is a difference of ±10% or less in atomic radius (ΔR) between alloy atoms, and 3) a similar heat of mixing relationship, which is a difference of ±10 kJ/mole or less of atom in enthalpy of mixing ($\Delta H_{mix}$) between alloy atoms. The HEA drew much attention due to its excellent mechanical properties including high strength and elongation, and recently, as the HEA is known to exhibit excellent characteristics such as high temperature property and low temperature property even in extreme environmental conditions, various studies are continuously being carried out.

However, since the current study on HEA is in its early stage, the study is mainly focused on the development of an alloy system having a single solid solution phase unlike the conventional commercial alloy systems, and thus the study on the control of characteristics by a second phase is being carried out at a very limited level. Additionally, a porous alloy which includes pores within its matrix has characteristics such as a large surface area as well as mechanical properties such as excellent elongation, energy absorption capacity, etc., while maintaining the characteristics of the existing materials with metallic structures, and thus many studies are being carried out in the area of functional materials as well as in structural materials. However, there is no study at all with regard to the development of porous alloys including HEA as a main component.

The above information disclosed in this Background section is only for enhancement of understanding of the background of the invention and therefore it may contain information that does not form the prior art that is already known in this country to a person of ordinary skill in the art.

PRIOR ART DOCUMENT

Non-Patent Document

[Document 1] EUROPEAN JOURNAL OF CONTROL. 2006. "Recent progress in high-entropy alloys." Jien-Wei YEH, p. 633-648

[Document 2] The Journal of The Minerals, Metals & Materials Society (TMS). 2012. "Computational Thermodynamics Aided High-Entropy Alloy Design" CHUAN ZHANG and three others, p. 839-845

[Document 3] Intermetallics. 2010. "Refractory high-entropy alloys." O. N. Senkov et al, p. 1758-1765

SUMMARY OF THE INVENTION

In order to solve the above-described problems in the conventional art, an object of the present invention is to provide a two-phase separating alloy, including a first phase including a HEA material having various crystal structures and a second phase, which is a phase-separated immiscible metal or alloy by miscibility gap, a HEA foam in which pores are formed within the HEA by selectively dissolving the second phase, and a manufacturing method for the foam.

In an exemplary embodiment of the present invention, the two-phase separating alloy includes a first phase including a high-entropy alloy (HEA) material, in which at least 3 metal elements act as a common solvent; and a second phase including at least one metal element (M).

The present invention provides a two-phase separating alloy where the HEA and metal elements are phase-separated like water and oil in a liquid state, by adding metal elements (M) having a positive (+) heat of mixing relationship with major elements which constitute the HEA.

In other words, for the constitution of a HEA where at least 3 metal elements act as a common solvent, it is necessary to have conditions such as to select metal elements having a similar difference of ±10% or less in atomic radius (ΔR) and a similar heat of mixing relationship, which is a difference of ±10 kJ/mole or less of atom in enthalpy of mixing ($\Delta H_{mix}$), and to synthesize in a similar atom ratio having a difference in content of 10 at. % or less between the corresponding elements. This is a general content drawn from the contents known so far with respect to HEA, but no perfect theory has been established regarding HEA, and thus it is not limited thereto but can be applied to any which can constitute a solid solution consisting of major elements of multi-components.

Additionally, a two-phase separating alloy can be formed through the formation of miscibility gap that induces a liquid separation between the HEA and immiscible metal elements and control of shape by adding elements having a large positive heat of mixing relationship with elements which constitute the HEA.

The alloys of the present invention may have a structure, in which a first phase has a dendritic structure by passing the tie-line including a monotectic reaction at the time of solidification and a second phase is located in the interdendritic regions, or may be a structure in which the first phase and the second phase are separated by miscibility gap.

Here, the two-phase separating alloy including the HEA by the present invention may be divided into two kinds; one having a face-centered cubic crystal (FCC) structure and another with a body-centered cubic crystal (BCC) structure.

First, the two-phase separating alloy including FCC HEA may consist of a first phase, which is a FCC HEA material where at least 3 metal elements selected from the element group II consisting of Cr, Mn, Fe, Co, and Ni act as a common solvent; and a second phase which is a single metal material selected from the element group I consisting of Cu, Ag, and Au.

A two-phase separating alloy including a first phase by FCC HEA formed by passing tie-line including a monotectic reaction at the time of solidification by mixing metals selected from Cu, Ag, and Au which have a positive (+) heat of mixing relationship with at least 3 elements selected from Cr, Mn, Fe, Co, and Ni constituting HEA, and a second phase which is separated from the first phase.

Particularly, in the case of constituting HEA, when all elements are constituted in an equiatomic ratio within the allowed range of 10 at. % error, it is preferable to embody an improved characteristic of a solid solution due to an entropy increase by constituting a solid solution base in a high-entropy state.

Here, HEA and metal (M) may be represented by a composition ratio of $M_{100-x}(HEA)_x$ (with the proviso, $5 \leq x \leq 90$ at. %), which is the amphiphilic composition of tie-line including a monotectic reaction; a two-phase separating alloy can be constituted within a broad composition range; and Ti, V, and Al may be further added in an amount of 15 at. % or less relative to that of the entire alloy elements for improving the mechanical characteristics of HEA. Additionally, it is also possible to add at least one an element among B, Si, Y, Zr, Nb, Mo, Ta, W, and Bi for improving mechanical properties via precipitation within the HEA in an amount of 10 at. % or less relative to that of the HEA.

Meanwhile, in the case of BCC HEA, to inhibit the phenomenon of forming an alloy with an extremely phase-separated structure without composite structurization by an excessively large difference in density (or atom) between the two separated phases of a first phase of BCC HEA and a second phase of M, a two-phase separating alloy having a uniformly phase-separated microstructure between the HEA dendrite and an immiscible alloy dendrite by controlling the composition of BCC HEA.

Particularly, the element groups may be divided into 3 groups for performing the above control. It is characterized in that at least one kind selected from Zr, Nb, Mo, Hf, Ta, and W, as the element group V, which is the major element group forming a first phase; at least one kind selected from Ti, V, and Cr, as the element group IV, which is an element group for constituting BCC HEA and an element group for controlling the excessive separation by the immiscible alloy composition being separated and the amount of atoms; and at least one kind selected from Y or elements of lanthanides such as La, Ce, Nd, Gd, Tb, Dy, Ho, and Er, which is an element group III forming an immiscible composition phase-separated by miscibility gap by having a large positive (+) heat of mixing with the element group IV and the element group V, are included.

In other words, the present invention is characterized in that at least one kind of a metal element selected from the element group III, and the element groups capable of forming BCC HEA while having a large positive (+) heat of mixing with the element group III are divided into element group IV and element group V according to the amount of atoms; at least one kind is selected from each of the group IV and the group V, and alloying a total of at least 3 metal elements from the group IV and the group V, and thereby a two-phase separating alloy consisting of a first phase with a dendritic BCC HEA material and a second phase, which is an alloy composition immiscible with the first phase, can be constituted. Here, the composition of the element group III (M) forming an immiscible alloy and the element group IV of BCC HEA and the element group V (HEA) is an amphiphilic composition of tie-line is $M_{100-x}(HEA)_x$ (with the proviso, $1 \leq x \leq 80$ at. %), and particularly, when the HEA composition, which is the first phase, is a composition ratio of $M_{100-x}(HEA)_x$ (with the proviso, $1 \leq x \leq 25$ at. %) forming a dendrite structure, a phase-separation alloy can be prepared even by a general casting process. In other words, when the amount of M is less than 1 at. %, the phase-separation phenomenon does not appear, whereas when the amount of M is 25 at. % or higher, it is difficult to prepare a two-phase separating alloy having a uniform composite structure due to the excessively large difference in enthalpy of mixing with Y, by a general casting process.

From the foregoing, the alloys of the present invention may have, as a composition region that pass through the tie-line including a monostatic reaction formed by the HEA base phase and the M base phase, a structure where the first phase of HEA has a dendritic structure and the second phase of M is located in interdendritic regions, or a structure where the first phase of HEA and the second phase of M are directly separated by miscibility gap. Particularly, also in the case of constituting the BCC HEA, when all elements are constituted in an equiatomic ratio within the allowed range of 10 at. % error, it is preferable to embody an improved characteristic of a solid solution due to an entropy increase by constituting a solid solution base of BCC in a high-entropy state.

Here, for the improvement of mechanical properties via precipitation within the HEA, it is possible to add at least one element among B, C, N, Al, and Si in a range of 10 at. % or less relative to the amount of HEA alloying elements of group IV and group V.

In an exemplary embodiment of the present invention, the manufacturing method for the HEA foam includes a step for preparing a raw material for preparing at least 3 metal elements that constitute a high-entropy alloy (HEA) material and at least one metal element material (M) having a positive (+) heat of mixing relationship with at least 3 metal elements that constitute the high-entropy alloy (HEA) material; a step for preparing an alloy for preparing a two-phase separating alloy, wherein a first phase comprising the high-entropy alloy (HEA) material and a second phase comprising at least one metal element (M) are separated from each other, by dissolving all the metal elements comprised in the step for preparing an alloy followed by cooling; and a step for selectively removing only the second phase and forming pores.

In the step for preparing the alloy, a two-phase separating alloy, where a first phase of HEA material having a higher melting point than a second phase by the sequence of transformation into a solid-phase, forms a dendritic structure and a second phase is located in the interdendritic regions, can be prepared, HEA foam with a dendritic structure can be prepared by removing the second phase from the two-phase separating alloy. Additionally, in the step for preparing the alloy, the development direction of the dendritic ligament may be controlled by controlling the cooling direction, and the dendritic thickness may be controlled by subsequent heat treatment.

And, in the step for preparing the raw materials, the internal porosity may be controlled by a method for controlling the ratio between the first phase and the second phase by controlling the ratio between HEA and the metal. That is, as an alternative method for controlling the internal porosity, it is possible to control the amount of the second phase being removed in the removal step of the second phase.

Meanwhile, when the ratio of the second phase being removed exceeds 50 vol. %, the remaining HEA may not be able to retain the bulk structural shape, and in that case, a step of sintering the remaining porous HEA may be further performed to prepare the HEA foam.

The HEA foam of the present invention is characterized in that it is a HEA material where at least 3 metal elements act as a common solvent, and pores are provided therein.

The HEA foam of the present invention has a structure where pores are distributed therein, and it exhibits an excellent physical characteristic by adding the characteristic due to a foam structure in addition to the characteristic of HEA.

The HEA foam may be one prepared by removing the second phase from the two-phase separating alloy, which consists of a first phase of a HEA material and a second phase of a metal material having a positive (+) heat of mixing relationship with the HEA, and may be one in which the internal porosity is controlled by controlling the ratio of the second phase. Additionally, it may be one prepared by sintering selectively dissolved HEA or HEA foam which cannot retain the bulky structural shape.

It is important to control the internal porosity in a foam structural body, and the HE foam of the present invention may be prepared by removing the second phase after first constituting the two-phase separating alloy, and thereby, the internal porosity can be controlled by controlling the ratio of the second phase.

Additionally, the internal shape of the HEA foam may be a dendritic structure by having the first phase in the form of a dendritic structure and removing the second phase located between interdendritic regions from the two-phase separating alloy.

Furthermore, FCC HEA may be one which consists of at least 3 metal elements selected from the element group II consisting of Cr, Mn, Fe, Co, and Ni, wherein the metal material constituting the second phase may be a single metal selected from the element group I consisting of Cu, Ag, and Au. Furthermore, for the improvement of mechanical characteristics by improving solid solubility, it is possible to add Ti, V, or Al in an amount of 15 at. % or less.

Meanwhile, in the case of BCC HEA, at least one kind selected from Zr, Nb, Mo, Hf, Ta, and W, as the element group V, which is the major element group forming a first phase; at least one kind selected from Ti, V, and Cr, as the element group IV, which is an element group for constituting BCC HEA and an element group for controlling the excessive separation by the immiscible alloy composition being separated and the amount of atoms; and at least one kind selected from Y or elements of lanthanides such as La, Ce, Nd, Gd, Tb, Dy, Ho, and Er, which is an element group III forming an immiscible composition phase-separated by miscibility gap by having a large positive (+) heat of mixing with the element group IV and the element group V, may be included. Additionally, for the improvement of mechanical properties by precipitation, it is possible to add at least one an element among B, C, N, Si, and Al in an amount of 10 at. % or less relative to BCC HEA.

Here, for the improvement of mechanical characteristics by the entropy control within the alloy, it is preferable to control all constituting elements in both kinds of HEA in an amount of 10 at. % or less for maximizing the characteristic of a solid solution.

The two-phase separating alloy of the present invention constituted as described above has an effect of capable of providing a novel alloy exhibiting a unique physical characteristic, in which the characteristic of the HEA and the characteristic of the second phase metal, because the first phase of the HEA material and the second phase of the metal material are separated and co-present.

Additionally, the manufacturing method for the HEA foam of the present invention has an effect of capable of preparing novel HEA foam, which was not available previously, by removing only the first phase after preparing the two-phase separating alloy including the first phase by HEA.

Furthermore, the HEA foam of the present invention has a structure where pores are distributed inside, and by adding an excellent functional characteristic such as low heat conductivity due to a foam structure in addition to the high strength characteristic of HEA, it exhibits an excellent physical characteristic where the two unique physical properties due to high-entropy effect and pores are combined.

BRIEF DESCRIPTION OF THE DRAWINGS

FIG. 2 shows the heat of mixing relationship between elements constituting the element group I and the element group II, which constitute the two-phase separating FCC HEA.

FIG. 5 shows a table illustrating the heat of mixing relationship between the elements constituting the element group III, the element group IV, and the element group V, which constitute the two-phase separating BCC HEA.

FIG. 7 shows (a) a concept diagram with respect to the process for forming a two-phase separating alloy having an interdendritic composite structure of the present invention and (b) images of the compositions of Comparative Example 14 and Example 20 observed under scanning electron microscope and the results of energy dispersive spectroscope (EDS) component analysis.

DETAILED DESCRIPTION OF THE EMBODIMENTS

Examples according to the present invention are explained in detail with reference to the accompanying drawings.

Figure 1:
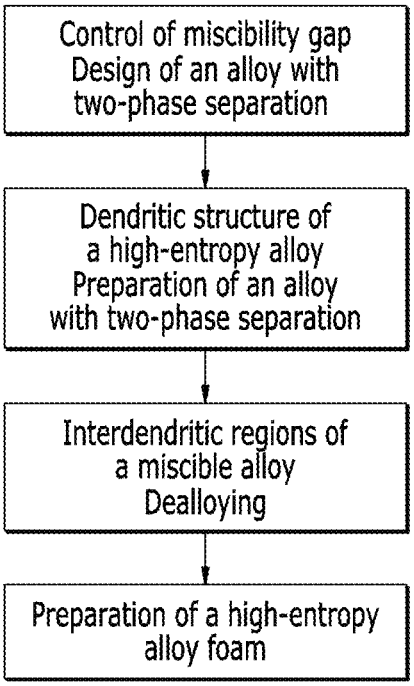
FIG. 1 is a flowchart schematically illustrating the process of the present invention.

FIG. 1 is a flowchart schematically illustrating the entire process for obtaining HEA foam of the present invention.

First, the two-phase separating alloy including the high-entropy alloy (HEA) according to Examples includes a first phase L1, which includes HEA where constituting elements of at least 3 components act as a common solvent and constitute a solid solution, and a second phase L2 which includes a separate metal material apart from the first phase, and the first phase and the second phase are separated from each other and co-present.

The HEA foam according to Examples are prepared by removing the second phase by selectively dealloying from the two-phase separating alloy including the HEA described above.

Here, the two-phase separating alloy can be divided into two types; HEA, which has an FCC crystal structure, and HEA, which has a BCC crystal structure. The process of designing the alloys is as follows.

Design of Two-Phase Separating FCC HEA

The step relates to designing a two-phase separating HEA with a face-centered cubic crystal structure, i.e., an FCC crystal structure. First, as the element group II constituting the FCC HEA which forms the first phase, at least 3 metal elements may be selected from Ni, Co, Cr, and Mn.

Next, the element group I, which is a major element for forming the second phase and mostly has a positive (+) heat of mixing relationship with the constituting elements may be at least one metal element selected from Cu, Ag, and Au.

FIG. 2 is a table summarizing the heat of mixing relationship between the elements reviewed in the present exemplary embodiment.

A heat of mixing relationship may be established between Fe, Ni, Co, Cr, and Mn, which are the elements constituting the first phase of HEA, where the difference in enthalpy of mixing ($\Delta H_{mix}$) is ±10 or less kJ/mole of atom, and Cu, Ag, and Au have a positive (+) heat of mixing relationship with elements, which constitute HEA, and thus can be easily separated.

Here, Fe, Ni, Co, Cr, and Mn, which are the constituting elements for the first phase have the heat of mixing relationship in the range of about +2 kJ/mol to about −7 kJ/mol ($\Delta H_{mix} \leq \pm 10$ kJ/mole of atom) with each other. Additionally, Fe, Ni, Co, Cr, and Mn have a similar atomic radius in the range of about ±10% as shown in Table 1 below. Accordingly, Fe, Ni, Co, Cr, and Mn can easily form a HEA solid solution.

TABLE 1

| Element | Cr | Mn | Fe | Co | Ni |
|---|---|---|---|---|---|
| Atomic radius (pm) | 166 | 139 | 156 | 152 | 149 |

For example, Cu has a relatively large positive (+) heat of mixing relationship with each of Fe, Ni, Co, Cr, and Mn. Accordingly, Cu may have a miscibility gap with HEA that induces the separation of a liquid (the separation of the first phase and the second phase) and a monotectic reaction (L→ a HEA solid solution+L2) may occur. Additionally, since the tie-line of the monotectic reaction is formed over a broad composition range, the phase between HEA and Cu can be easily separated at the time of solidification.

Preparation of Two-Phase Separating FCC HEA

A two-phase separating alloy including HEA can be prepared by an arc melting method.

Since the arc melting method embody high temperature via arc plasma, a homogeneous solid solution in bulk shape can be rapidly formed, and minimize the impurities such as oxides and pores, and thus selected. In addition to the arc melting method, it may be prepared using a commercial casting process by utilizing an induction casting method which has an agitation effect by electromagnetic field during dissolution and resistance heating method capable of precise temperature control. Furthermore, a commercial casting method capable of dissolving high melting point metals may be used, and may be prepared by spark plasma sintering via powder metallurgy after preparing raw materials in powder, etc., or by sintering at high temperature/high pressure using hot isostatic pressing sintering. Here, the sintering method has a merit in that the method enables a more precise control of microstructures and preparation of parts with a desired shape.

The following Table 2 shows compositions of Comparative Examples and the phases represented by the compositions for the comparison with those in Examples according to the present invention.

TABLE 2

| Specimen | Composition | Crystal Structure |
|---|---|---|
| Example 1 | $Cu_{20}(FeNiCo)_{80}$ | 2 phase FCC (L1 + L2) |
| Example 2 | $Cu_{20}(FeNiCoCr)_{80}$ | 2 phase FCC (L1 + L2) |
| Example 3 | $Cu_{20}(FeNiCoCrMn)_{80}$ | 2 phase FCC (L1 + L2) |
| Example 4 | $CuFeNiCoCrMnV_{0.5}$ | 2 phase FCC (L1 + L2) |
| Example 5 | $CuFeNiCoCrMnTi_{0.5}$ | 2 phase FCC (L1 + L2) |
| Example 6 | $CuFeNiCoCrMnAl_{0.5}$ | 2 phase FCC (L1 + L2) |
| Example 7 | $Cu_{90}(FeNiCoCr)_{10}$ | 2 phase FCC (L1 + L2) |
| Example 8 | $Cu_{80}(FeNiCoCr)_{20}$ | 2 phase FCC (L1 + L2) |
| Example 9 | $Cu_{70}(FeNiCoCr)_{30}$ | 2 phase FCC (L1 + L2) |
| Example 10 | $Cu_{60}(FeNiCoCr)_{40}$ | 2 phase FCC (L1 + L2) |
| Example 11 | $Cu_{50}(FeNiCoCr)_{50}$ | 2 phase FCC (L1 + L2) |
| Example 12 | $Cu_{40}(FeNiCoCr)_{60}$ | 2 phase FCC (L1 + L2) |
| Example 13 | $Cu_{30}(FeNiCoCr)_{70}$ | 2 phase FCC (L1 + L2) |
| Example 14 | $Cu_{10}(FeNiCoCr)_{90}$ | 2 phase FCC (L1 + L2) |
| Comparative Example 1 | Ni | Single FCC |
| Comparative Example 2 | NiCo | Single FCC |
| Comparative Example 3 | FeNiCo | Single FCC |
| Comparative Example 4 | FeNiCoCr | Single FCC |
| Comparative Example 5 | FeNiCoCrMn | Single FCC |
| Comparative Example 6 | Cu | Single FCC |
| Comparative Example 7 | $Cu_{20}Ni_{80}$ | Single FCC |

TABLE 2-continued

| Specimen | Composition | Crystal Structure |
|---|---|---|
| Comparative Example 8 | CuFe | FCC Fe + FCC Cu |
| Comparative Example 9 | CuNiCo | Single FCC |
| Comparative Example 10 | $Cu_{20}(FeNi)_{80}$ | Single FCC |

Figure 3:
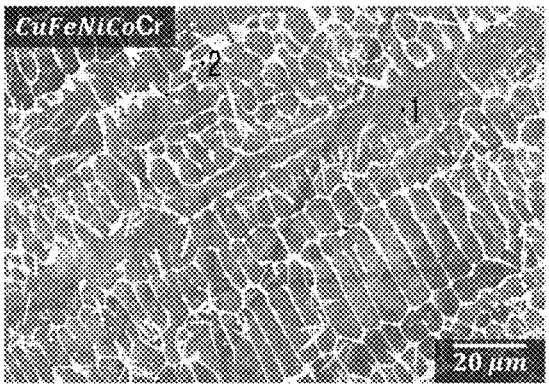
FIG. 3 shows the results of scanning electron microscope and X-ray spectroscopic analysis with respect to Example 2 among the high-entropy two-phase separating alloys prepared by alloying the elements which constitute the element group I and the element group II.

FIG. 3 shows images observed under scanning electron microscope with respect to Example 2 and the phase separating phenomenon can be confirmed by the difference in clear contrast between each phase. That is, the dark region in FIG. 3 represents the first phase part by HEA, and the bright part represents the second phase part by Cu, and these can be confirmed by X-ray spectroscopic analysis and energy dispersive X-ray spectroscopy (EDS).

Figure 4:
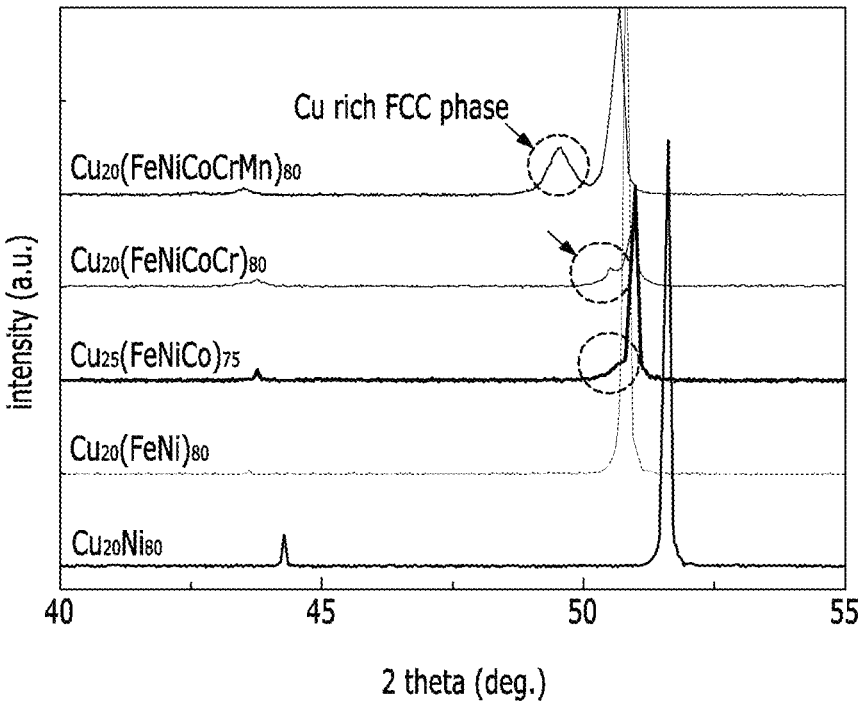
FIG. 4 shows the XRD analysis results with respect to Examples 1 to 5.

Such a phenomenon can be more explicitly confirmed by an analysis using X-ray. FIG. 4 shows the results of XRD analysis with respect to Examples according to the present invention. Here, Cu which has a positive heat of mixing with the FCC HEA, which has a composition of Fe—Ni—Co, Fe—Ni—Co—Cr, and Fe—Ni—Co—Cr—Mn, was analyzed by 20% alloying relative to HEA. In fact, the alloys of Example 1 to 3 showed peaks which represent the results of phase separation into L1 and L2, however, in the cases of Comparative Examples 7 and 10, where phase-separation HEA cannot be constituted, phase separation was not observed.

The two-phase separating alloy including HEA according to the present invention may further include at least one an element among Ti, V, and Al in an amount of about 15 at. % or less relative to the entire alloy element (Examples 4 to 6). Examples 4 to 6 can also have structures with two-phase separation.

Examples 7 to 15 show the cases where the composition ratio between HEA and Cu in two-phase separating alloys of Fe—Ni—Co—Cr HEA and Cu was controlled. As the result of XRD analysis, in Examples 7 to 15 where the Cu ratio was shown to vary from about 10 at. % to about 90 at. %, the peaks by both L1 and L2 phases were observed thus confirming the formation of two-phase separating alloys. That is, even in cases where the Cu ratio was variously changed from about 5 at. % to about 90 at. % in the amphiphilic composition range of tie-line including a monotectic reaction, the phenomenon of separation of the first phase L1 and the second phase L2 can be maintained, wherein the microstructures may be altered depending on the Cu ratio.

Furthermore, the two-phase separating alloys according to Examples may exhibit unique physical characteristics because the physical property included in the second phase is combined to the excellent physical property of HEA as the L1 phase by HEA and the L2 phase by a metal are separated.

For example, the electric conductivity of Cu may be combined to HEA thereby exhibiting extremely excellent electric conductivity. The alloy with the FeCoCrNiCu composition corresponding to Example 2 exhibited a unique characteristics with excellent micro-strength and electric conductivity compared to the existing conventional alloys.

Meanwhile, the two-phase separating alloy including HEA may further include heterogeneous elements for the control of mechanical properties of HEA via precipitation. For example, a two-phase separating alloy including HEA may include at least one an element selected from B, Si, Y, Zr, Nb, Mo, Ta, W, and Bi in an amount of about 10 at. % or less relative to that of HEA, and thereby, the mechanical characteristic can be improved while maintaining the L1 phase of HEA and the L2 phase of a metal. For example, heterogeneous elements can strengthen alloys by making a trace amount of deposition.

Design of Two-Phase Separating BCC HEA

Similarly to the FCC HEA described above, the two-phase separating BCC HEA can also exhibit a phase-separation effect within the amphiphilic composition of the tie-line including a monotectic reaction by an appropriate design of alloys. The two-phase separating alloy including HEA includes a first phase of BCC HEA, where at least 3 constituting elements act as a common solvent via control of a miscibility gap formed within the alloy of BCC HEA thereby constituting a solid solution, and a second phase, which is a composition material immiscible with the first phase, wherein the first phase and the second phase are separated from each other.

First, the BCC HEA to form the first phase of the two-phase separating alloy including HEA may include at least 3 metal elements among Ti, V, Cr, Zr, Nb, Mo, Hf, Ta, and W.

Here, in order to prevent that the first phase of BCC HEA forms an extreme layered structure and becomes separated due to the difference in density with the immiscible metal (or alloy) constituting the second phase, Ti, V, and Cr, which are elements having an atomic amount lower than that of Y, may be classified into element group IV, whereas, Zr, Nb, Mo, Hf, Ta, and W, which are elements having an atomic amount higher than that of Y, may be classified into element group V.

The first phase of the two-phase separating alloy including HEA includes at least one kind of an element from the element group IV and must include at least one kind of an element from the element group V.

The second phase includes Y and at least one kind of lanthanide element such as La, Ce, Nd, Gd, Tb, Dy, Ho, and Er, which have a relatively large positive (+) heat of mixing relationship with the constituting elements of the first phase, and these elements are classified into the element group III.

FIG. 5 is a table in which the heat of mixing relationship of elements that constitute the present invention are summarized.

Referring to FIG. 5, it can be seen that the elements of Ti, V, Cr, Zr, Nb, Mo, Hf, Ta, and W, which constitute the BCC HEA of the first phase, have a similar heat of mixing relationship where the difference of enthalpy of mixing ($\Delta H_{mix}$) is within the range of about ±10 kJ/mole of atom. In contrast, it can be confirmed that Y and the elements of the lanthanides described above have a large amount of heat of mixing relationship with the elements of Ti, V, Cr, Zr, Nb, Mo, Hf, Ta, and W, which constitute the BCC HEA of the first phase, in an amount of about +10 kJ/mole of atom or higher, respectively.

Figure 6:
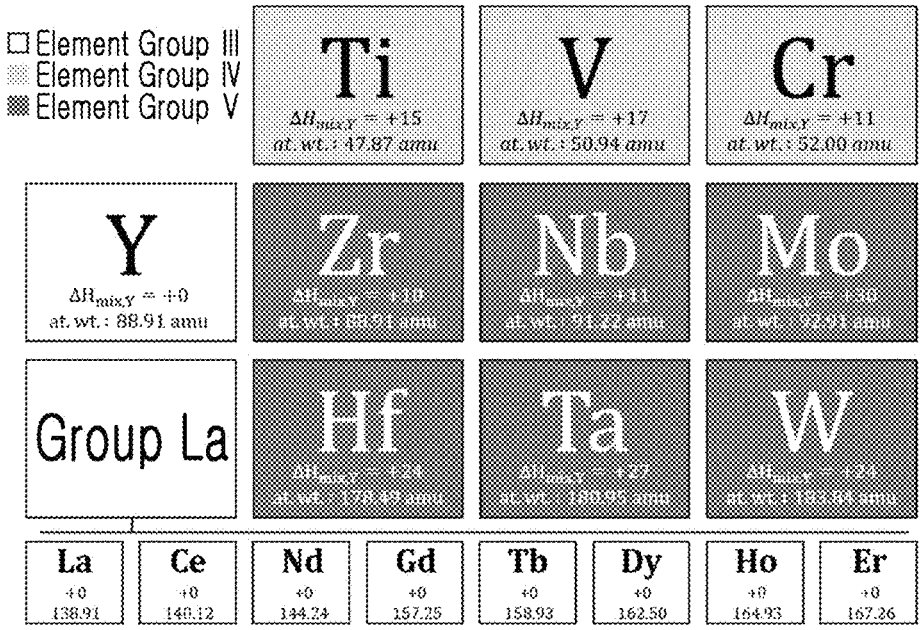
FIG. 6 is a diagram comparing the amounts of heat of mixing and atoms between the element group III, the element group IV, and the element group V, confirming the large differences in the amount of atoms between each element group.

FIG. 6 shows a diagram illustrating the element group III, the element group IV, and the element group V, in which the elements constituting the present invention are classified according to the atomic amount and heat of mixing relationship. As can be seen in this diagram, there is a big difference in atomic amount between the element group III and the element group V and thus an extreme phase-separation behavior due to a difference in density may occur. In order to prevent such a phenomenon and embody the microstructure of a uniform composite alloy, a design of an alloy was performed such that, among the metal elements that constitute the BCC HEA, those elements which have atomic amount smaller than that of Y, which is an alloy element constituting an immiscible region, was classified into the element group IV while those elements which have atomic amount greater than that of Y was classified into the element group V, and at least one element from each group should be included in the alloy.

As can be seen in the diagram, it was confirmed that there is a similar heat of mixing ($\Delta H_{mix} \leq \pm 10$ kJ/mole of atom) relationship in the range of about −6 to about +2 kJ/mol between the constituting elements, exclusive of Y, and as shown in Table 3 below, it was confirmed that each of the alloying elements has a similar difference of ±10% or less in atomic radius and is thus a suitable condition for constituting HEA.

TABLE 3

| Element | Ti | V | Cr | Zr | Nb | Mo | Hf | Ta | W |
|---|---|---|---|---|---|---|---|---|---|
| Atomic radius (pm) | 200 | 192 | 200 | 230 | 208 | 201 | 225 | 209 | 210 |

In contrast, for example, Y has a big positive (+) heat of mixing relationship in the amount of about +15 kJ/mole of atom or higher with all the elements constituting the HEA with a body-centered cubic crystal structure. Accordingly, in the case of an alloy, which is prepared by a combination of BCC HEA (the first phase), which consists of the element group IV and the element group V, and the element group III (the second phase), the first phase and the second phase may be easily separated when a melt solution is solidified.

Preparation of Two-Phase Separating BCC HEA

The two-phase separating alloy including HEA may be prepared by arc melting method. Meanwhile, hereinafter, among the Y and lanthanide elements which constitute the element group III, the description has been mostly focused on Y, which shows a representative characteristic in the heat of mixing relationship with the element group V, atomic amount, etc., but the exemplary embodiments are not limited thereto.

Since arc melting method is explained in detail above and is thus omitted herein below.

The following Table 4 shows each of the compositions in Examples and Comparative Examples and the crystal structures on the phase and microstructures on the phase that appear when each composition is solidified.

TABLE 4

| | Composition | Crystal Structure | Microstructure Shape |
|---|---|---|---|
| Example 15 | Y—Ti—MoNb | 2 phase (BCC + HCP) | Interdendritic composite structurization |
| Example 16 | Y—Ti—MoNbHf | 2 phase (BCC + HCP) | Interdendritic composite structurization |
| Example 17 | Y—Ti—MoNbHfTa | 2 phase (BCC + HCP) | Interdendritic composite structurization |
| Example 18 | Y—TiV—Mo | 2 phase (BCC + HCP) | Interdendritic composite structurization |
| Example 19 | Y—TiV—MoNb | 2 phase (BCC + HCP) | Interdendritic composite structurization |
| Example 20 | Y—TiV—MoNbTa | 2 phase (BCC + HCP) | Interdendritic composite structurization |
| Example 21 | Y—TiVCr—Mo | 2 phase (BCC + HCP) | Interdendritic composite structurization |
| Example 22 | Y—TiVCr—MoNb | 2 phase (BCC + HCP) | Interdendritic composite structurization |
| Example 23 | Y—TiVCrMoNbTa | 2 phase (BCC + HCP) | Interdendritic composite structurization |
| Comparative Example 11 | VNbMoTaW | Single phase (BCC) | A single solid solution of BCC |
| Comparative Example 12 | NbMoHfTaW | Single phase (BCC) | A single solid solution of BCC |
| Comparative Example 13 | Y—MoNb | 2 phase (BCC + HCP) | Solidification with a separate alloy with a layered structure |
| Comparative Example 14 | Y—MoNbTa | 2 phase (BCC + HCP) | Solidification with a separate alloy with a layered structure |

FIG. 7 shows (a) a concept diagram with respect to the process for forming a two-phase separating alloy having an interdendritic composite structure of the present invention and (b) images of the compositions of Comparative Example 14 and Example 20 observed under scanning electron microscope and the results of energy dispersive spectroscope (EDS) component analysis.

As can be seen in FIG. 7(*a*), in the HEA which consists of only the elements of the element group V, the layered separation phenomenon that it is extremely separated due to the difference in atomic amount with the Y element of the element group III can be confirmed, and thus, a two-phase separating alloy having a composite interdendritic structure cannot be prepared. Accordingly, the two-phase separating alloy including HEA should surely include the element group IV, which has a relatively small atomic amount and is easy to form BCC HEA by easily forming a solid solution with the element group V, and by doing so, an interdendritic composite structure between the first phase, which includes BCC HEA, and the second phase, which includes a metal immiscible with the first phase, can be formed.

FIG. 7(*b*) shows the scanning electron microscope and energy dispersive spectroscope (EDS) component analysis results of the Y—MoNbTa composition of Comparative Example 14 and the Y—TiV—MoNbTa composition of Example 20. As can be seen above, in the case of the alloy with the composition of Comparative Example, the Y-rich phase and the BCC HEA phase with the MoNbTa composition had a layered structure and an extremely separated alloy was formed, whereas, in the case of the composition of Example 20 where Ti and V, elements of the element group IV, were added to Comparative Example 4, a preferable microstructure with an interdendritic composite structure was obtained.

Figure 8:
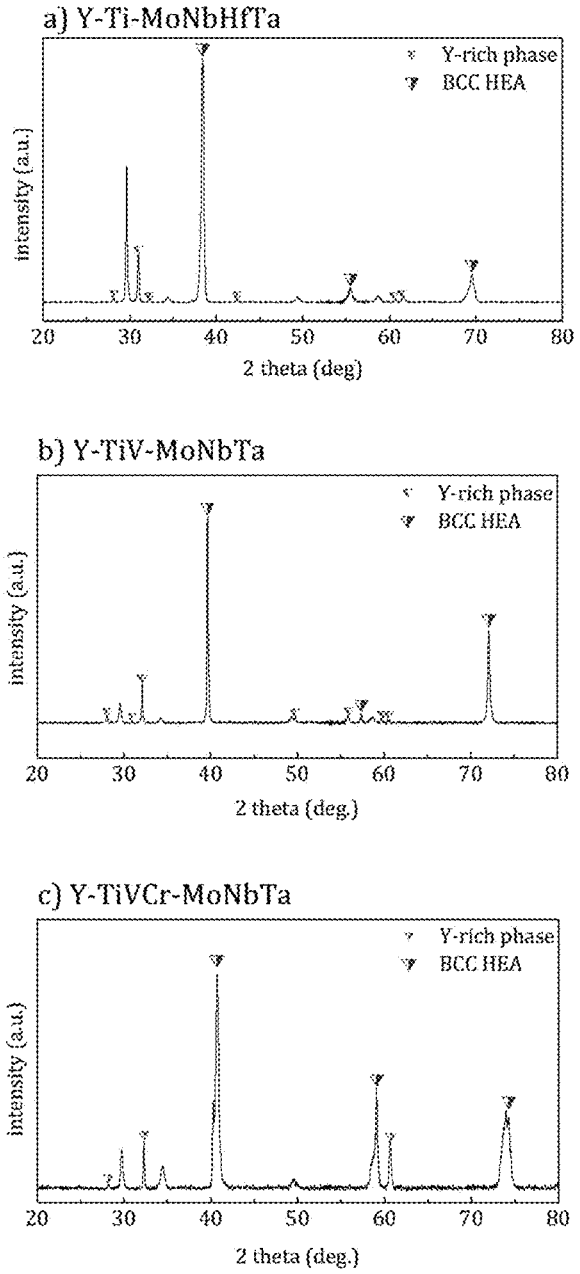
FIG. 8 shows the results of XRD analysis for Examples 17, 20, and 23.

Here, FIG. 8 shows the results of XRD analysis with regard to the phase-separation BCC HEA including one to three elements of the element group IV, respectively, and correspond to Examples 17, 20, and 23. It was confirmed that a two-phase separating behavior with a BCC-HCP crystal structure between the first phase of the BCC HEA composition and the second phase of Y-rich phase, by performing the alloying by selecting at least one kind of element Y selected from the element group III, 1 to 3 kinds of elements selected from the element group IV, and at least 2 kinds of elements selected from the element group V, through each of the analysis results.

From the above results of X-ray diffraction analysis, it was confirmed that in the present invention, regardless of the number of elements in each element group, an interdendritic composite structured two-phase separating alloy, consisting of the dendritic region of the BCC HEA composition, which consists of the element group IV and the element group V, and the dendritic region mainly consisting of the element group I.

Furthermore, in the two-phase separating alloy of the present invention, the first phase including the BCC HEA and the second phase including a metal (or alloy) which is immiscible with the first phase are composite structured and thus the physical property of the immiscible metal is combined with the excellent mechanical properties of the BCC HEA, thereby improving the unique physical characteristics.

Meanwhile, the two-phase separating alloy including HEA may further include at least one an element selected from B, C, N, Si, and Al in an amount of 10 at. % or less relative to that of HEA, for the control of mechanical properties via precipitation of BCC HEA. Accordingly, the alloy can improve mechanical properties via micro-precipitation while maintaining the first phase of BCC HEA matrix and the second phase of immiscible metal matrix.

Preparation of High-Entropy Alloy Foam

The HEA foam according to Examples have a composite structure where pores are from inside of HEA. An alloy foam or metal foam decreases its density by internal pores but due to its large surface area it is being used as electrode materials, heat storing materials, etc., and efforts to utilize its heat-blocking characteristic by pores forms inside, etc., have been continued. Additionally, an artificial composite material, which is difficult to form naturally, may be prepared by filling the pores with a different material.

HEA foam is prepared using a two-phase separating alloy including HEA, and the manufacturing method includes a step for preparing a metal element as a raw material for preparing a two-phase separating alloy; a step for preparing an alloy for preparing a two-phase separating alloy; and a step for removing the second phase from the two-phase separating alloy.

Here, the two-phase separating alloy including HEA includes both the two-phase separating alloy including FCC HEA described above and the two-phase separating alloy including BCC HEA.

The step for preparing a raw material is a step for preparing a raw material which is designed by the design of the two-phase separating alloy described above, and the step for preparing an alloy is the same as explained above in the preparation of a two-phase separating alloy and thus the detailed explanation is omitted herein below.

The step for removing the second phase is a step for removing only the second phase L2 from an alloy thereby leaving only the first phase L1 which includes HEA and alters the position where the second phase L2 was located with pores thereby forming HEA foam.

Figure 9:
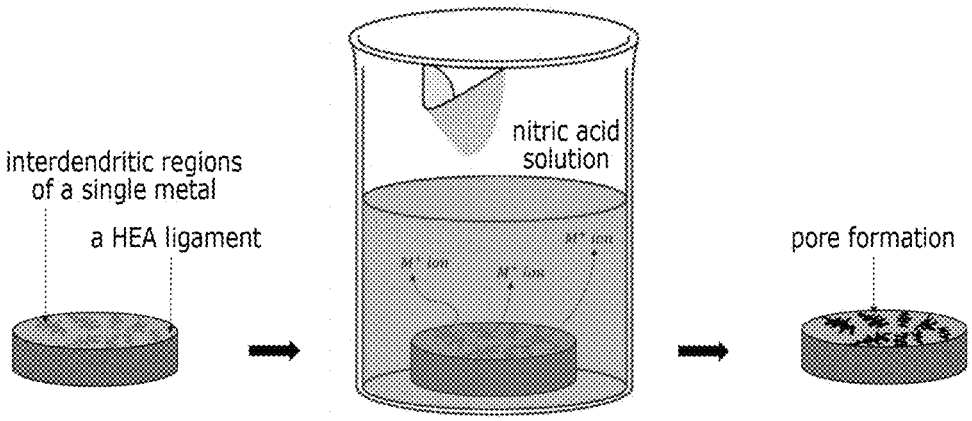
FIG. 9 shows a schematic diagram illustrating that a high-entropy foam can be prepared from a prepared two-phase separating alloy in a nitric acid solution via dealloying.

FIG. 9 is a schematic diagram illustrating the chemical dealloying process by the present invention. The dendritic region corresponding to the second phase can be removed by the difference in galvani potential by promoting galvani battery reaction by dipping the prepared two-phase separating alloy into a diluted nitric acid solution. Here, it is possible to completely remove the second phase and it is also possible to retain a part thereof for the control of porosity by controlling the processing time.

Figure 10:
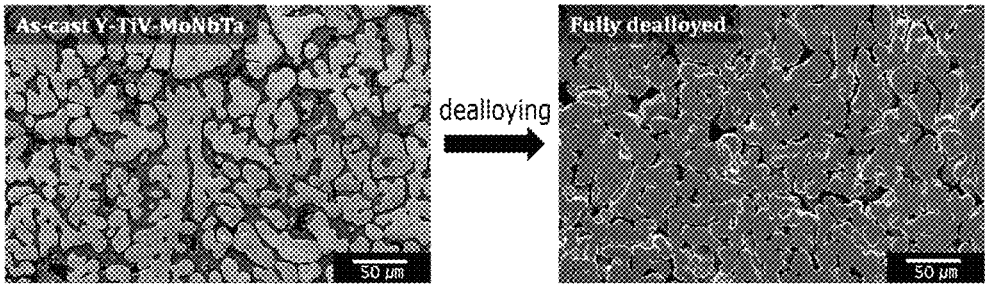
FIG. 10 shows the actual analysis results of the surface of Example 20 observed under scanning electron microscope before and after performing a dealloying process.

FIG. 10 shows images of specimens of Example 20 composition observed under scanning electron microscope before and after dealloying process. As can be seen in FIG. 10, in the case of the Y—TiV—MoNbTa composition alloy, it was confirmed that the interdendritic composite structure between the TiV—MoNbTa HEA dendrite and the Y-rich dendrite in a casting state (left), and BCC HEA foam of the MoNbTa composition having a unique pore structure can be prepared by selective dissolution of the Y-rich interdendritic regions after dealloying (right).

In other words, it was confirmed that the pores in which the interdendritic regions were removed inside of the entire structural body by selective galvanic corrosion, and as such, it was confirmed that the foam with a porous structure can be formed.

Figure 11:
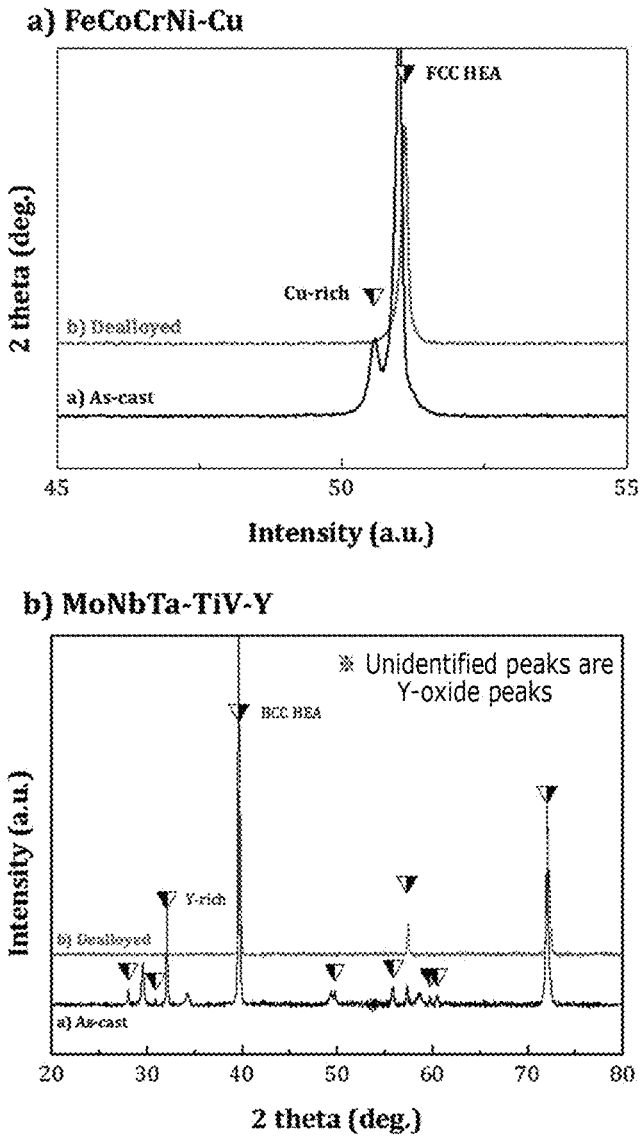
FIG. 11 shows the XRD analysis results of Examples 2 and 20 before and after performing a dealloying process.

FIG. 11 shows the results of XRD analysis with respect to (a) FCC HEA two-phase separating alloy of Example 2 and (b) BCC HEA two-phase separating alloy of Example 20 before and after the removal of L2 phase.

As illustrated, it was confirmed that the peak of the second phase, which was confirmed in Example 2 and Example 20, disappeared after going through with the step for removing the second phase by the electrochemical dealloying process. That is, it was confirmed by X-ray analysis that chemical dealloying process is a process suitable for the preparation of HEA foam.

Figure 12:
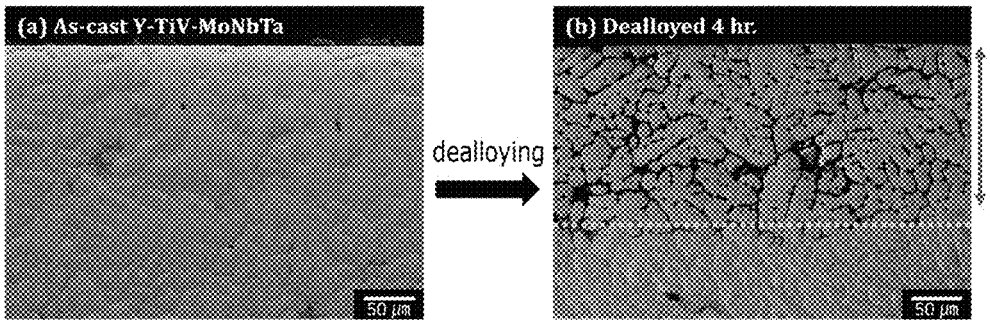
FIG. 12 shows the cross-sectional images of the high-entropy alloy foam prepared in Example 20 illustrating the difference in depth of formed foams from the surface according to the dealloying time.

FIG. 12 shows cross-sectional images illustrating that the porosity of the HEA foam prepared in Example 20 can be controlled by the processing time of dealloying. From the images illustrated therein, it can be seen that the dealloying proceeded along with the depth direction according to time passage, and for example in (a) depicting the cross-section of the as-cast state, it was confirmed that the corrosion proceeded partially up to the depth of about 300 μm in the case of (b) where the entire dealloying process was proceeded only for 4 hours in a diluted nitric acid solution having a concentration of 0.3 mol/L.

Figure 13:
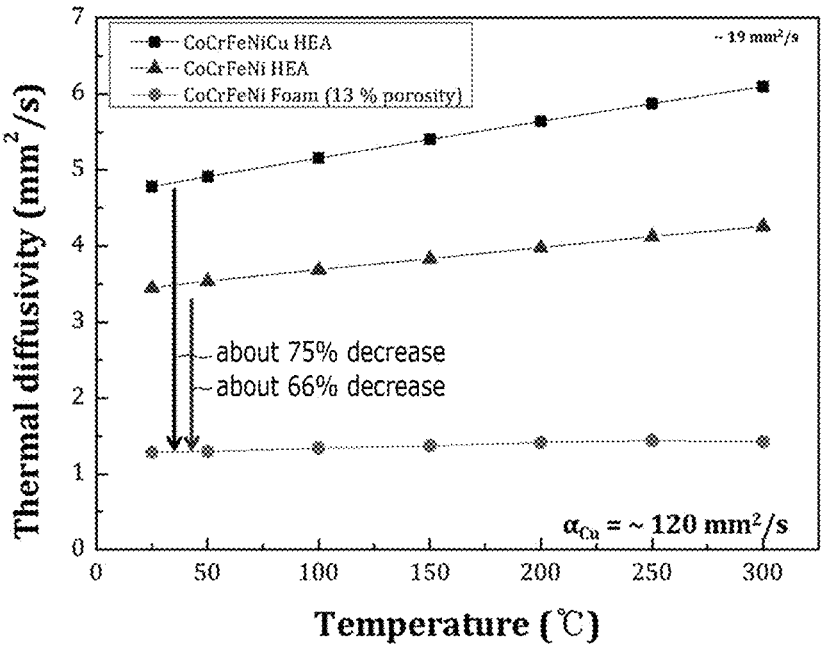
FIG. 13 shows the measurement results of thermal diffusion coefficient (α, thermal diffusivity) with regard to the two-phase separating alloy prepared in Example 2 and the alloy prepared in Comparative Example 4 and the alloy foam prepared in Example 2.

FIG. 13 shows the measurement results of thermal diffusion coefficient with respect to the two-phase separating FCC HEA of Example 2 and the HEA foam prepared from the alloy of Comparative Example 4 and Example 2, and the values are proportional to thermal conductivity.

Here, the HEA foam prepared in Example 2 by removing L2 phase showed a decrease of about 75% in thermal conductivity compared to Example 4, and also showed a decrease of about 66% compared to the HEA with a structure of a single solid solution of Comparative Example 4, which is known to have a superbly low thermal conductivity even compared to the general alloy. This is due to the pores formed inside the HEA foam having very low thermal conductivity, and it is speculated that the alloy with a foam structure can be highly applicable to a thermal barrier material, etc., by using the characteristic.

Additionally, in the case of an alloy foam, a physical property different from that of the original material alloy may appear by the pore structures formed inside the foam, and representatively, it is known that elongation can increase due to the limitation in crack propagation. Although only the results of thermal conductivity characteristics were provided with respect to the HEA in Examples of the present invention, various changes in physical properties according to the formation of HEA foam may be utilized.

Additionally, the HEA foam prepared from the two-phase separation of Example 2 showed a porosity of about 18 vol. %, and as in two-phase separating alloys in other Examples, Cu composition can control the porosity by controlling the ratio on the second phase.

Meanwhile, when the ratio of the metal or alloy that constitutes the second phase is extremely high, the HEA foam may not show the connected dendrite or, even when connected, the conjugation may be too weak thus becoming difficult to finally maintain the perfect shape. Here, the HEA foam may be prepared by a method of sintering the pieces of the precipitated HEA foam.

While this invention has been described with reference to preferred embodiments, a skilled person in the art to which the present invention pertains will be able to understand that the embodiments are for illustrative explanation of the technical concepts of the present invention and various modifications can be made within the scope not departing from the technical concepts of the present invention. Accordingly, the scope of the present invention should not be interpreted by particular embodiments but based on the description in the scope of claims and all the technical concepts within the equivalent scope thereof should be interpreted to be included within the scope of the present invention.

What is claimed is:

1. A method of manufacturing a high-entropy alloy foam of $M_{100-x}(HEA)_x$ ($5 \leq x \leq 90$), the method comprising:

preparing a raw material comprising:

a high-entropy alloy with a face-centered cubic crystal structure comprising:

Mn; and at least two metal elements selected from a group of Cr, Fe, Co, and Ni; and at least one additive metal element selected from a group of Cu, Ag and Au of 10 at % or less relative to the high-entropy alloy, the additive metal element having a positive heat of mixing relationship with the high-entropy alloy; and dissolving and cooling an alloy comprising:

a first phase comprising the high-entropy alloy; and a second phase comprising the at least one additive metal element, the second phase separated from the first phase; and selectively removing the second phase by electrochemical dealloying and then forming pores; and wherein the M represents the additive metal element and the HEA represents the high-entropy alloy.

2. The method of claim 1, wherein in the selectively removing the second phase, the electrochemical dealloying is performed by promoting galvani battery reaction by dipping the alloy into nitric acid solution.

3. The method of claim 1, wherein the high-entropy alloy further comprises at least one metal element among Ti, V, and Al of 15 at % or less of the high-entropy alloy in the preparing a raw material.

4. The manufacturing method of claim 1, wherein in the preparing a raw material, the high-entropy alloy further comprises at least one metal element among B, Si, Y, Zr, Nb, Mo, Ta, W and Bi of 10 at % or less of the high-entropy alloy.

5. The method of claim 1, wherein the first phase has a dendritic structure and the second phase is located in interdendritic regions in the dissolving and cooling an alloy; and wherein the second phase is removed from the alloy and thus the pores are located in the interdendritic regions in the selectively removing the second phase.

6. The method of claim 1, wherein the alloy is solidified with monotectic reaction in the cooling an alloy.

7. The method of claim 1, wherein the second phase is over 50 vol % in the dissolving and cooling an alloy, the method further comprises sintering the alloy from which the second phase is selectively removed.

8. A method of manufacturing a high-entropy alloy foam of $M_{100-x}(HEA)_x$ ($1 \leq x \leq 25$), the method comprising:

preparing a raw material comprising:

a high-entropy alloy with a body-centered cubic crystal structure comprising:

at least one metal element selected from a group of Ti, V, and Cr; and at least one metal element selected from a group of Zr, Nb, Mo, Hf, Ta and W; and at least one additive metal element selected from a group of Y, La, Ce, Nd, Gd, Tb, Dy, Ho, and Er having a positive heat of mixing relationship with the high-entropy alloy; and dissolving and cooling an alloy comprising:

a first phase comprising the high-entropy alloy; and a second phase comprising the at least one additive metal element, the second phase separated from the first phase; and selectively removing the second phase by electrochemical dealloying and then forming pores; and wherein the M represents the additive metal element and the HEA represents the high-entropy alloy.

9. The method of claim 8, wherein in the selectively removing the second phase, the electrochemical dealloying is performed by promoting galvani battery reaction by dipping the alloy into nitric acid solution.

10. The method of claim 8, wherein the alloy is solidified with monotectic reaction in the cooling an alloy.

11. The method of claim 8, wherein the high-entropy alloy further comprises at least one metal element among B, C, N, Al and Si of 10 at % or less of the high-entropy alloy in the preparing a raw material.

12. The method of claim 1, wherein the first phase has a dendritic structure and the second phase is located in interdendritic regions in the dissolving and cooling an alloy; and wherein the second phase is removed from the alloy and thus the pores are located in the interdendritic regions in the selectively removing the second phase.

13. The method of claim 8, wherein the second phase is over 50 vol % in the dissolving and cooling an alloy, the method further comprises sintering the alloy from which the second phase is selectively removed.

* * * * *